US006972689B1

(12) United States Patent
Morgan et al.

(10) Patent No.: US 6,972,689 B1
(45) Date of Patent: Dec. 6, 2005

(54) PORTABLE SIGN SYSTEM

(75) Inventors: James B. Morgan, Brookings, SD (US); Bradley T. Wiemann, Brookings, SD (US); Jean-Louis Legault, Laval (CA); Jacques Legault, Lachenaie (CA); Alex Peetroons, Terrebonne (CA); Luc Jacob, Lachenaie (CA)

(73) Assignee: Daktronics, Inc., Brookings, SD (US)

( * ) Notice: Subject to any disclaimer, the term of this patent is extended or adjusted under 35 U.S.C. 154(b) by 406 days.

(21) Appl. No.: 10/283,568

(22) Filed: Oct. 30, 2002

(51) Int. Cl.[7] ..... G08B 5/00
(52) U.S. Cl. ..... 340/815.4; 340/815.47; 340/815.53; 340/815.83; 340/908
(58) Field of Search ..... 340/815.4, 815.41, 340/815.47, 815.53, 815.6, 815.83, 907, 340/908

(56) References Cited

U.S. PATENT DOCUMENTS 3,883,846 A * 5/1975 Bruner ..... 40/550
5,257,020 A * 10/1993 Morse ..... 340/908.1
5,542,203 A * 8/1996 Luoma et al. ..... 40/610
6,496,123 B2 * 12/2002 Brinkman ..... 340/908
6,552,257 B1 * 4/2003 Hart et al. ..... 136/246

* cited by examiner

*Primary Examiner*—Toan N. Pham
(74) *Attorney, Agent, or Firm*—Hugh D. Jaeger, Esq.

(57) ABSTRACT

A portable sign system being self-contained and having a digital display panel which can be hydraulically raised to a suitable height and subsequently be rotated by a worm gear which is manually driven or electrically driven by a motor. A broad based upper assembly having an UHMW plastic stabilizing plate and rotation plates and attached worm gear drive serves as a rotatable and stabile mount for a digital or other display panel and an attached solar array. The digital display panel is automatically locked in azimuthal position by the worm gear drive without a conscious operator effort. Azimuth orientation of the digital display panel can be effected by a hand crank, manually by an electrical switch, automatically by an onboard computer control or by remote control.

56 Claims, 10 Drawing Sheets

PORTABLE SIGN SYSTEM

CROSS REFERENCES TO RELATED APPLICATIONS

None.

BACKGROUND OF THE INVENTION

1. Field of the Invention

The present invention is for a sign system, and more particularly is for a portable sign system.

2. Description of the Prior Art

Prior art portable signs often require that a sign be elevatable for unrestricted viewability and that the sign be rotatable to orient the sign to a viewer's field of vision for the best suitable viewing. After the sign or display is rotated, it is desirable to lockingly fix the sign in a desirable azimuthal position. Such locking may be accomplished by various methods of frictional engagement by personnel of various qualifications. Such methods require one or more additional steps to lock and fix the sign in the required direction, thus requiring additional time and effort spent in the process. Such methods of rotational fixation can be rendered moot or ineffective if the operator of the portable sign fails for whatever reason to lock the sign in the desired viewing position whereby wind forces could cause the sign to rotatingly migrate or weather vane from the desired viewable position. Additionally, unwanted rotation, such as if the sign is unlocked, could occur if the trailer upon which the sign was mounted was not perfectly level, whereby the sign can be misaligned such as by gravitational forces. Stability of elevated rotatable signs during rotation and while static is another consideration in the design and use of portable elevated and rotatable portable signs. Rotation and elevating of a sign can also be hampered while operating under adverse wind conditions to cause elevational or rotational binding or resistance.

The present invention overcomes the deficiencies of prior art devices by providing a portable sign system which is not subject to a separate locking method and which does not require a separate or additional step by the operator. The present invention automatically locks against sign rotation immediately subsequent to rotation of the sign with no locking attempt by the operator. Stability of the sign is provided for by use of an upper assembly which provides a wide rotational base and whereby rotational binding or resistance is minimized by the incorporation of ultra high molecular weight (UHMW) plastic components. The present invention includes the ability to rotate the sign by a hand crank, by an electrical switch, automatically by microprocessor control, or by remote control for viewing from different locations.

SUMMARY OF THE INVENTION

The general purpose of the present invention is to provide a portable sign system having an elevatable and rotatable sign.

According to one or more embodiments of the present invention, there is provided a portable sign system having a trailer frame and including components mounted to the trailer frame to provide a portable sign system. A centrally located column having an outer positionable tube and a vertically fixed co-located inner tube and having planar UHMW plastic material therebetween and having a hydraulic actuating cylinder located centrally within is secured to the trailer frame to provide a support for an upper assembly and for components secured thereto. The upper assembly secures to the upper region of the column to provide rotatable support structure for the horizontal and vertical digital display panel suspension supports. The horizontal and vertical digital display panel suspension supports serve as a support for a peripheral digital display panel frame and a digital display panel or sign mounted and attached thereto. The horizontal digital display panel suspension supports also provide for support of various components of a positionable solar array which is rotated with the digital display panel. A support bearing secures over and about a lower region of the centrally located column for rotational support of the bottom of the peripheral digital display panel frame and digital display panel for support during rotation of the peripheral digital display panel frame and digital display panel. The upper assembly at the top of the centrally located column provides for stabile rotational structure for rotation of the peripheral digital display panel frame and digital display panel and of the positionable solar array about the vertical axis of the centrally located column. The upper assembly includes a mounting box, a worm gear drive, an angled worm drive, a box flange, a fixed rotation plate, a UHMW plastic stabilizing disk, a positionable rotation plate, a support bearing assembly, a motor, an encoder coupled to the motor shaft, a hand crank receptor, and other components complementary to the rotational functions of the peripheral digital display panel frame and digital display panel and positionable solar array about the centrally located column. The fixed rotation plate, the UHMW plastic stabilizing disk, and the positionable rotation plate are broad and wide to promote stability of the peripheral digital display panel frame and digital display panel and the positionable solar array during raising and rotation, as well as during static use thereof. A self-locking feature which prevents digital display panel rotation by outside forces such as wind is provided by the worm gear which exhibits normal anti-turning characteristics inherent in the design thereof. An optional hand crank is provided for manual operation of the angled worm drive and the worm gear if required in lieu of actuation by the motor. The positionable solar array is adjustable by means of a hand-operated jack in order to place the panel at a suitable angle with respect to the sun. Also adding to the stability of the invention are a plurality of hand-operated jacks located about the trailer frame. A detachable tow bar secures to the trailer frame at points distant from the outer frame of the trailer to deter theft. A control panel, including a microprocessor, is provided to display programmed messages of various sizes for viewing and for operation of the invention, including rotational facilitation by a manual switch, by automatic microprocessor control or by remote control rotation of the digital display panel.

One significant aspect and feature of the present invention is a portable sign system which is self-contained.

Another significant aspect and feature of the present invention is a portable sign system having a vertically positionable and rotatable digital display panel incorporating at one or more worm gears for azimuthal rotation of the elevatable digital display panel and of an attached solar array.

Still another significant aspect and feature of the present invention is a portable sign system incorporating a worm gear for automatic locking of a digital display panel and attached solar array to prevent inadvertent rotation of the digital display panel and solar array.

Yet another significant aspect and feature of the present invention is a portable sign system incorporating a worm gear for azimuthal actuation of a digital display panel and solar array which can be turned by a motor or by a hand crank.

An additional significant aspect and feature of the present invention is a portable sign system incorporating a wide base upper assembly to provide for stability of the digital display panel and solar array during raising and during rotation of the digital display panel and solar array.

A still additional significant aspect and feature of the present invention is a portable sign system having a wide base upper assembly including a UHMW plastic stabilizing disk for stabilization and for use to reduce friction and to promote smoothness during rotation.

A further significant aspect and feature of the present invention is the incorporation of a microprocessor for controlling of programmed messages and for interfacing with an encoder which senses azimuthal directional control of a digital display panel.

A still further significant aspect and feature of the present invention is the ability to control azimuthal digital display orientation manually by a switch or hand crank, automatically by onboard microprocessor control, or by remote control.

Having thus described an embodiment and significant aspects and features of the present invention, it is the principal object of the present invention to provide a portable sign system.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENT

Figure 1:
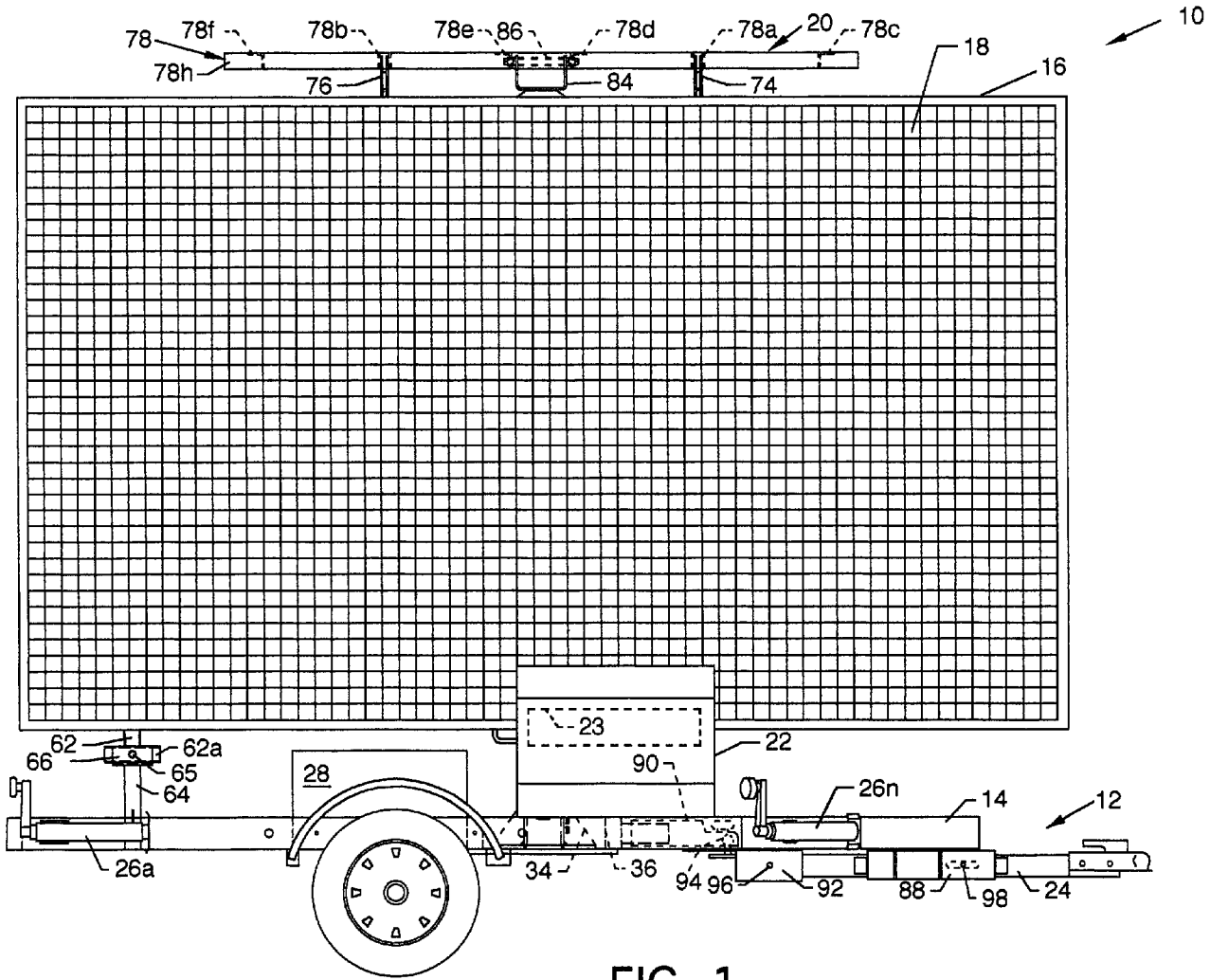
FIG. 1 illustrates a plan view of a portable sign system, the present invention.
Figure 9:
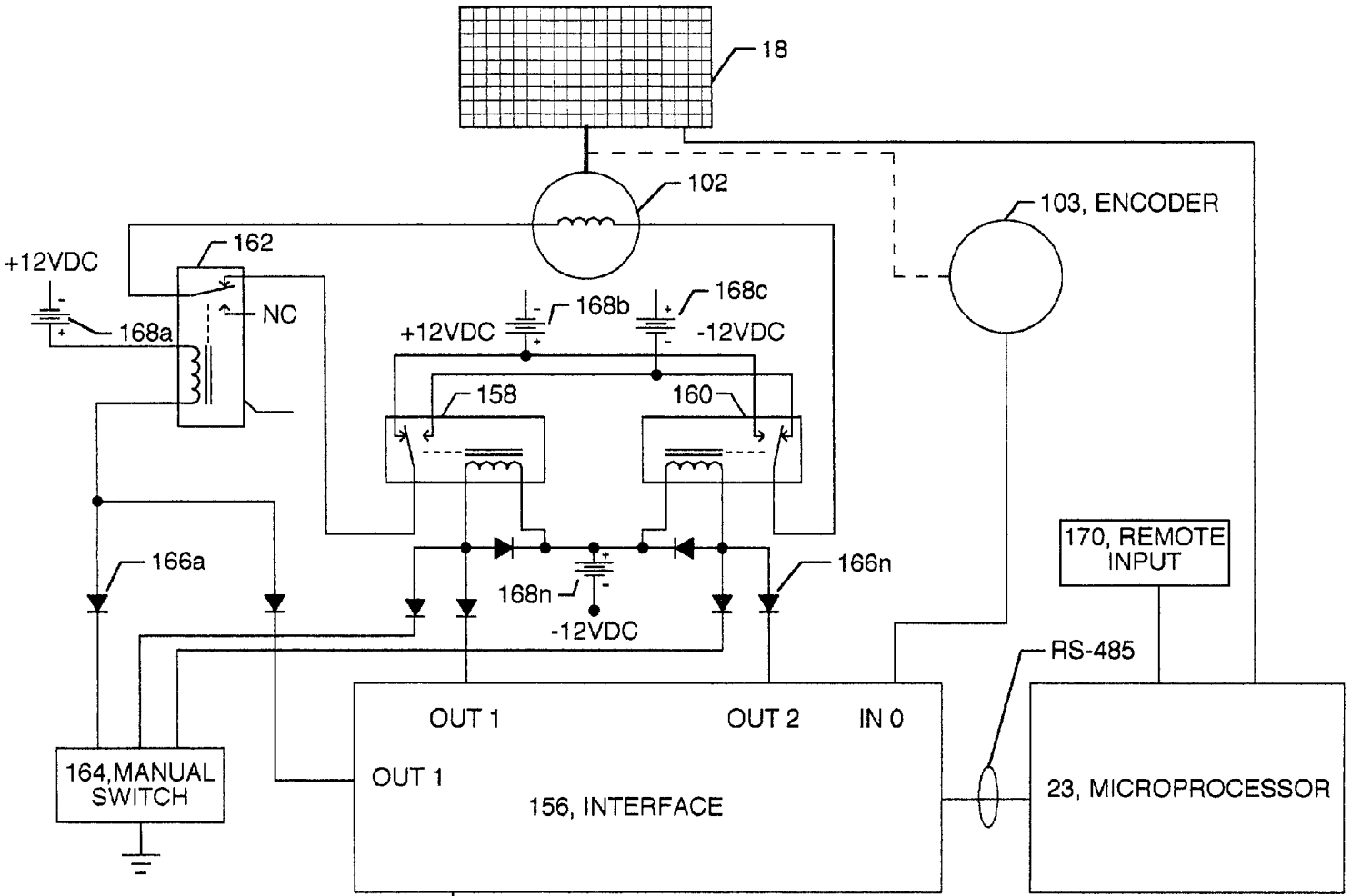
FIG. 9 illustrates circuitry for electronic azimuth control of the digital display panel; and, FIG. 10 illustrates the mode of operation of the portable sign system.

FIG. 1 illustrates a plan view of a portable sign system 10, the present invention. Readily discernible and visible components of the invention include a trailer 12, a trailer frame 14, a digital display panel 18 having a surrounding peripheral digital display frame 16 rotatably secured to the trailer frame 14, as later described in detail with reference to FIG. 2, a solar array 20, a control panel 22, a detachable tow bar 24, a plurality of jacks 26*a*–26*n* secured to the trailer frame 14, and a platform 28 transversely mounted to the trailer frame 14. The control panel 22 is utilized to control the functions of the portable sign system 10 and includes controls to operate the mechanical functions including a microprocessor 23 to control the messages displayed on the digital display panel 18. The microprocessor 23 is also incorporated to provide for azimuthal control of the digital display panel 18 automatically or by remote control. An electrical manual switch 164, shown in FIG. 9, is used for manual electrical rotation of the digital display panel 18. Power for the control panel 22 is provided by the solar array 20 which charges internally located storage batteries.

Figure 2:
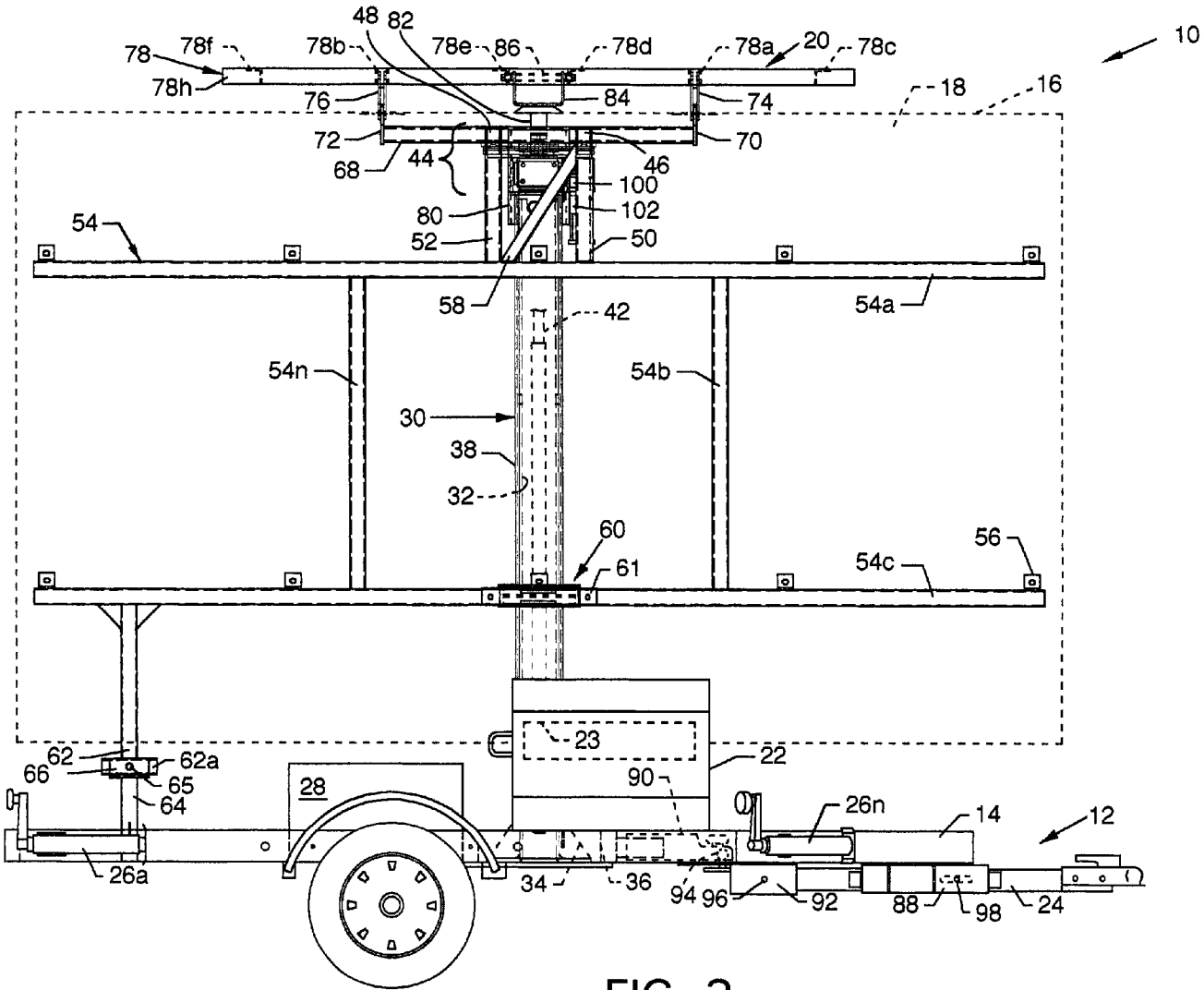
FIG. 2 illustrates the view of FIG. 1 where the digital display panel and a peripheral digital display panel frame are shown as dashed lines.
Figure 3:
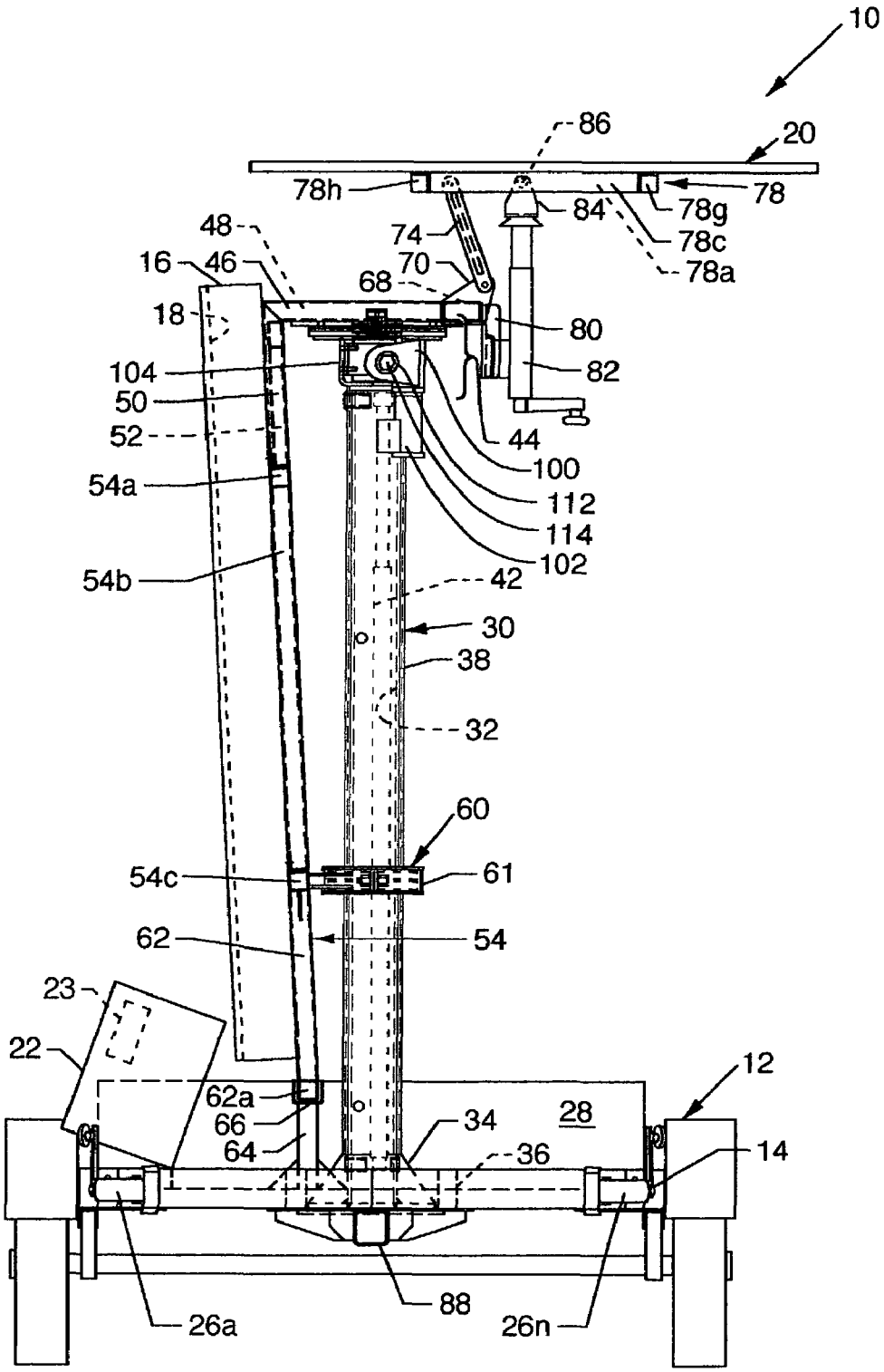
FIG. 3 illustrates a front view of the portable sign system.
Figure 4:
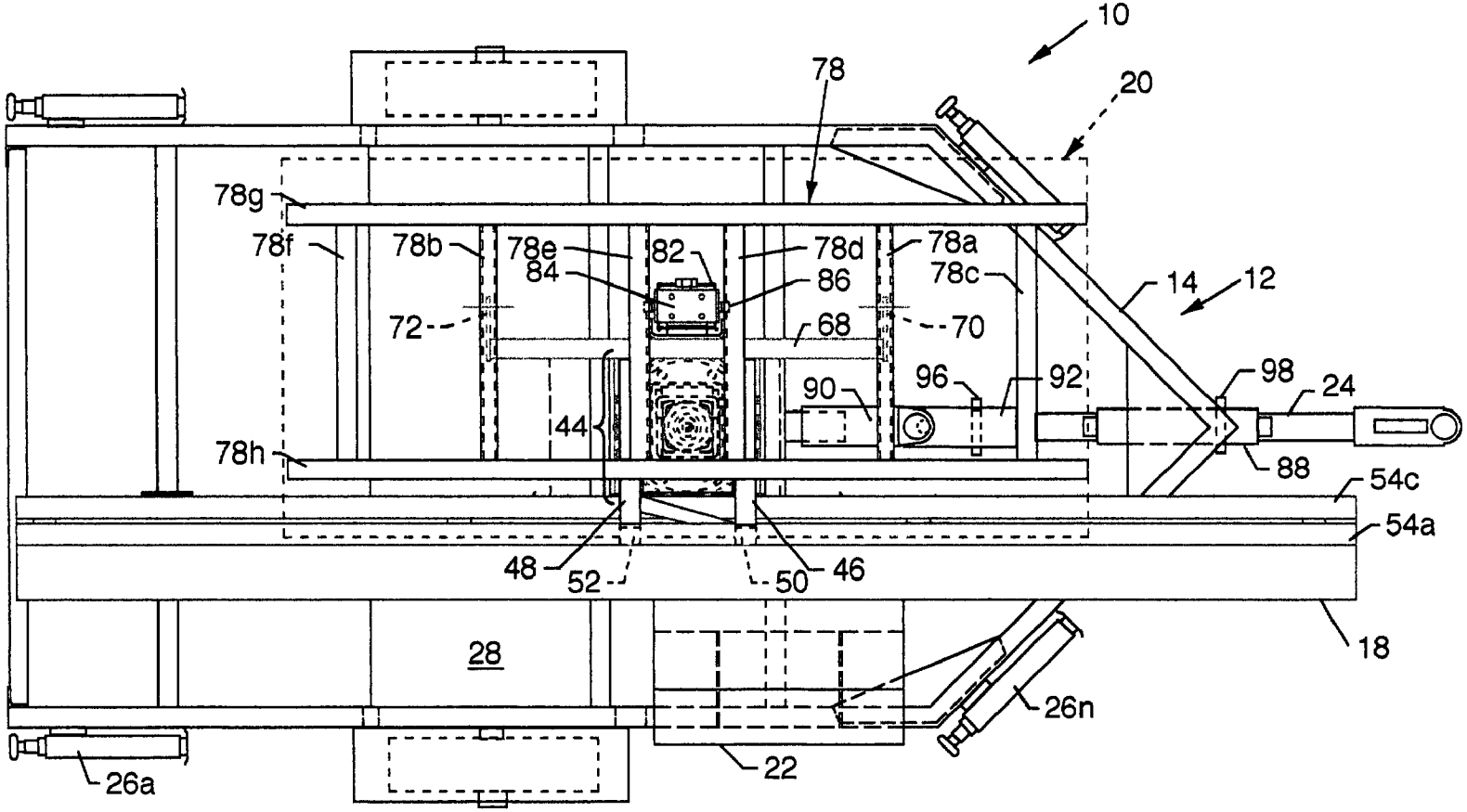
FIG. 4 illustrates a top view of the portable sign system.

FIG. 2 illustrates the view of FIG. 1 where the digital display panel 18 and the peripheral digital display panel frame 16 are shown as dashed lines to reveal the components therebehind. FIG. 3 illustrates a front view of the portable sign system 10, and FIG. 4 illustrates a top view of the portable sign system 10. With reference to FIGS. 2, 3 and 4, certain significant components of the present invention are now described. A tubular column 30, preferably of square tubular stock, includes a fixed inner tube 32 having a base 34 which secures to the trailer frame 14 via an intermediate boxed framework 36 located in the central region of the trailer frame 14, as well as a positionable outer tube 38 aligned over and about the fixed inner tube 32. A plurality of UHMW plastic panels 40*a*–40*n* (FIG. 5) are disposed between the outer surface of the fixed inner tube 32 and the inner surface of the positionable outer tube 38 and as such are secured to the outer sides of the inner tube 32. Placement of the UHMW plastic panels 40*a*–40*n* as described provides for reduction of friction and smoothness during the raising and lowering process. A hydraulic actuating cylinder 42 secures at its lower end to the base 34 or other suitable region located near the lower end of the fixed inner tube 32 and to the inner and upper region of the positionable outer tube 38 and is actuated to extend the positionable outer tube 38 vertically with relationship to the inner tube 32. An upper assembly 44, described later in detail, secures to the top of the positionable outer tube 38 to serve as a rotatable mount substantially for the digital display panel 18 and the solar array 20 via intermediate support components.

Opposed horizontal tubes 46 and 48 secure to the top of the upper assembly 44 and a tube 50 extends downwardly at less than a 90-degree angle from one end of the horizontal tube 46 and another tube 52 extends downwardly at less than a 90 degree angle from one end of the horizontal tube 48, as best viewed in FIGS. 3 and 4. Tubes 50 and 52 together present an angled mounting structure for attachment of a vertically aligned framework 54 having tubes 54*a*–54*n* and a plurality of like attachment points 56 to which the digital display panel 18 secures. Such angular support allows the digital display panel 18 and attached peripheral digital display panel frame 16 to be oriented at an angle with respect to the vertical to appropriately deflect oncoming headlight and other glare. Tubes 50 and 52 secure to the framework tube 54*a* such as by welding. An additional tube 58 secures diagonally between the upper end of the tube 50 and the junction of tube 52 and tube 54*a* for additional support. Additional support for the framework 54 and of the digital display panel 18 is afforded by a support bearing 60 secured by a collar 61 over and about a mid region of the centrally located tubular column 30 for rotational and static support during static display or rotation of the peripheral digital display panel frame 16 and solar array 20. The collar 61 which encompasses the support bearing 60 attaches to the framework tube 54*c*. Additional support of the peripheral digital display panel frame 16 and digital display panel 18 during transport along a roadway is provided by the accommodation of a stabilizer bar 62 extending downwardly from the framework tube 54*c* by a stabilizer bar receptor 64. The stabilizer bar 62 includes a horizontally oriented tube 62*a* at its lower end and the stabilizer bar receptor 64 includes a horizontally oriented channel 66 in which the horizontally oriented tube 62*a* may be pinned such as by introduction of pin 65 through channel 66 and the horizontal tube 62*a*.

A horizontally oriented solar panel support bar 68 secures across the remaining ends of the horizontal tubes 46 and 48 located at the top of the upper assembly 44. Upwardly extending and opposed vertically oriented pivot plates 70 and 72 are mounted at the ends of the solar panel support bar 68 to provide pivotal mounts for the lower ends of dual plate linkage bars 74 and 76. The upper ends of dual plate linkage bars 74 and 76 attach to cross member channels 78*a* and 78*b* of a solar panel framework 78 having cross member channels 78*a* and 78*b* and cross member angles 78*c*, 78*d*, 78*e*, and 78*f* aligned between horizontally oriented cross member tubes 78*g* and 78*h* to partially support the solar panel framework 78 and attached solar array 20. A bracket 80 secures to and extends downwardly from the solar panel support bar 68 to support a manually operated jack 82 which lends partial and adjustable support to the solar panel framework 78 and attached solar array 20. The base portion of an angled bracket 84 suitably secures to the upper end of the jack 82 and the upright portions of the angled bracket 84 secure to the solar panel framework 78 at cross member angles 78*d* and 78*e* by a readily removable pin 86 (FIG. 2). The removable pin 86 can be disengaged from the angled bracket 84 and solar panel framework 78 to allow the solar panel framework 78 and attached solar array 20 to reposition about the pivotable dual plate linkage bars 74 and 76 towards the upper assembly 44 to provide for a low profile for transport along a roadway. The jack 82 also pivots about the bracket 80 to assume a low transportation profile.

Also shown in FIG. 2 is a front tow bar receptor 88 in the form of a box tube and a female connector/brake assembly 90 mounted about the trailer frame 14 which accommodates or attaches to the detachable tow bar 24. Also shown is a rear tow bar receptor 92 in the form of an unattached box tube which is not welded to the trailer frame 14 which includes a ball connector 94 extending vertically therefrom for reception by the female connector/brake assembly 90. The rearward end of the detachable tow bar 24 is first accommodated by the rear tow bar receptor 92 and a securing pin 96 extending therethrough and subsequently is attached via the ball connector 94 to the female connector/brake assembly 90. A securing pin 98 extends through a slotted portion of the detachable tow bar 24 and through the front tow bar receptor 88 to further secure the detachable tow bar 24 to the trailer 12. Such a feature as described having a female connector/brake assembly 90 located distant from the front of the trailer 12 discourages theft of the invention, as connection thereto is only readily accomplished with the proprietary design of the tow bar 24 and the ancillary devices incorporated therein.

Figure 5:
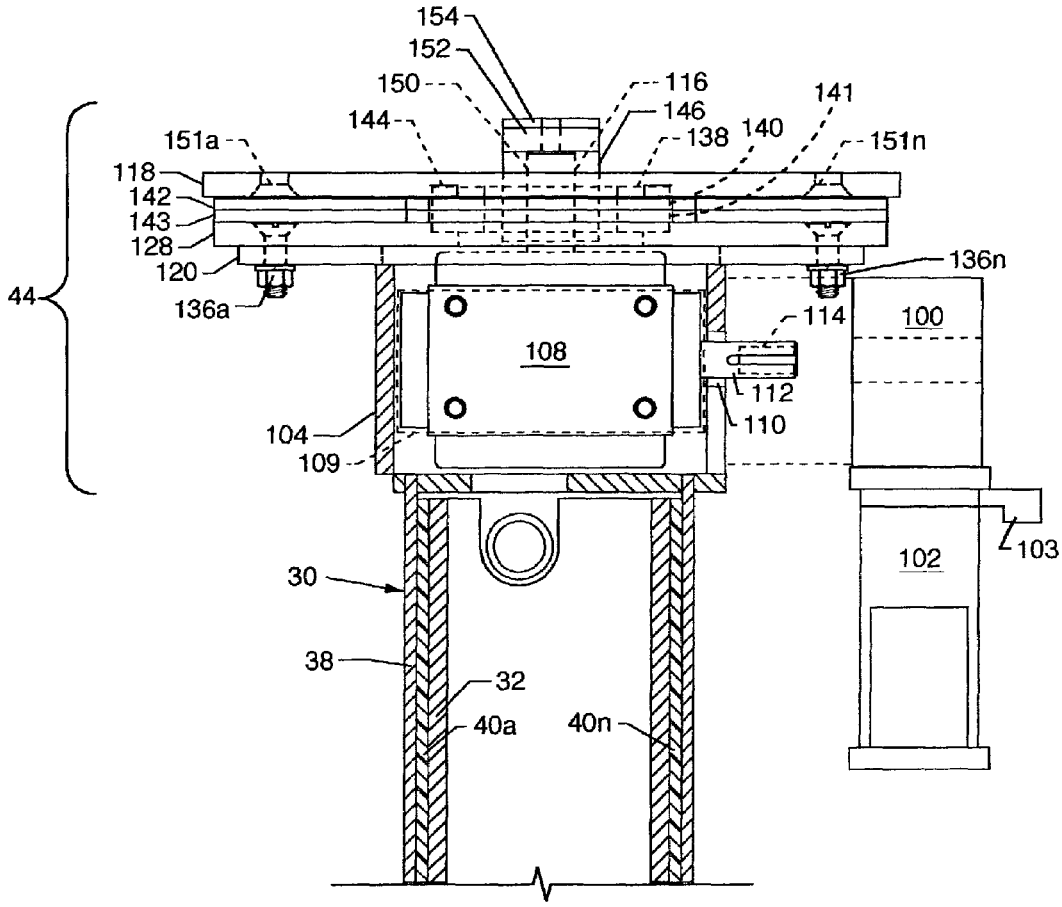
FIG. 5 illustrates a side view of an upper assembly in partial cross section mounted to the top of a tubular column.
Figure 6:
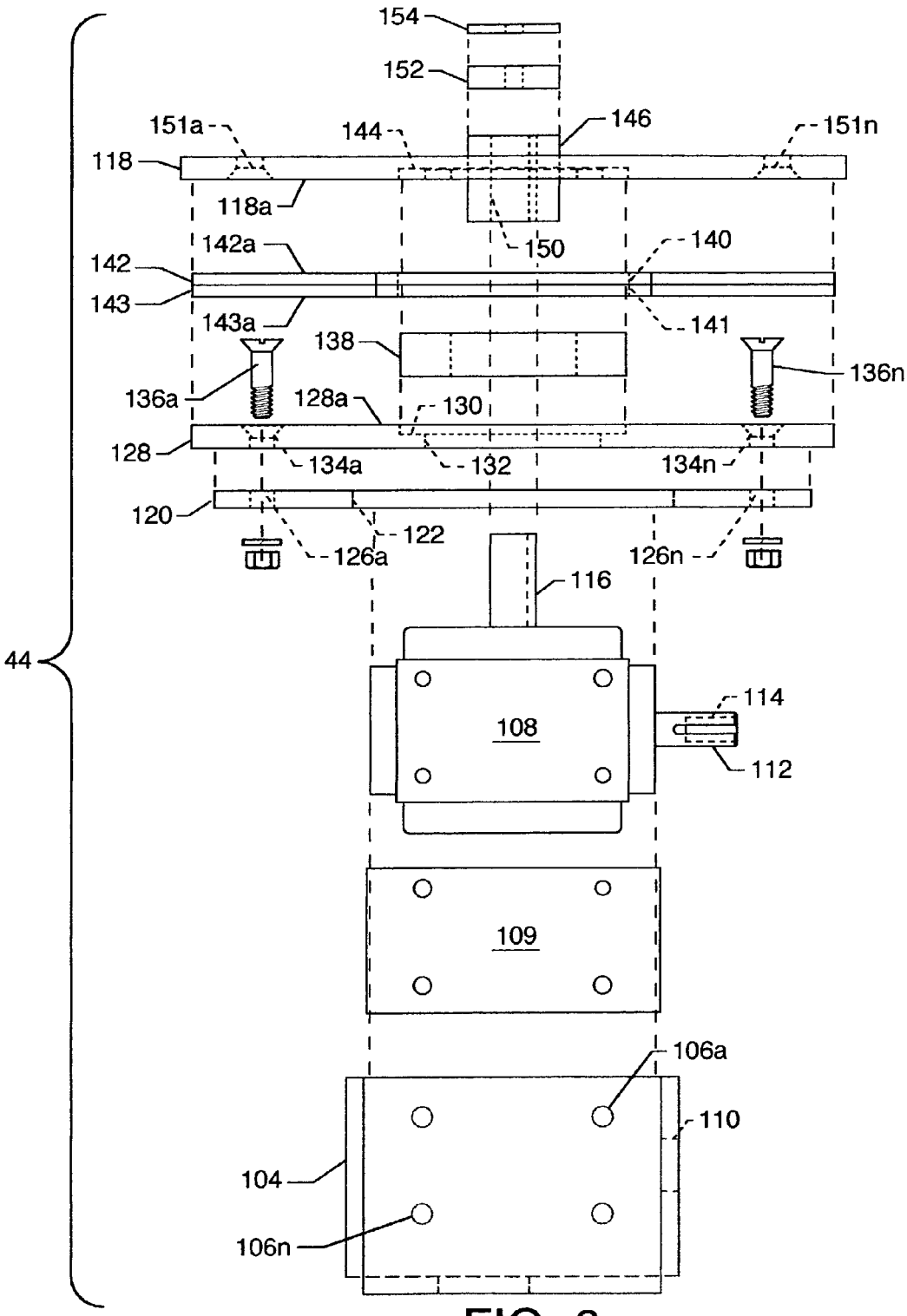
FIG. 6 illustrates an exploded side view of the upper assembly.
Figure 7:
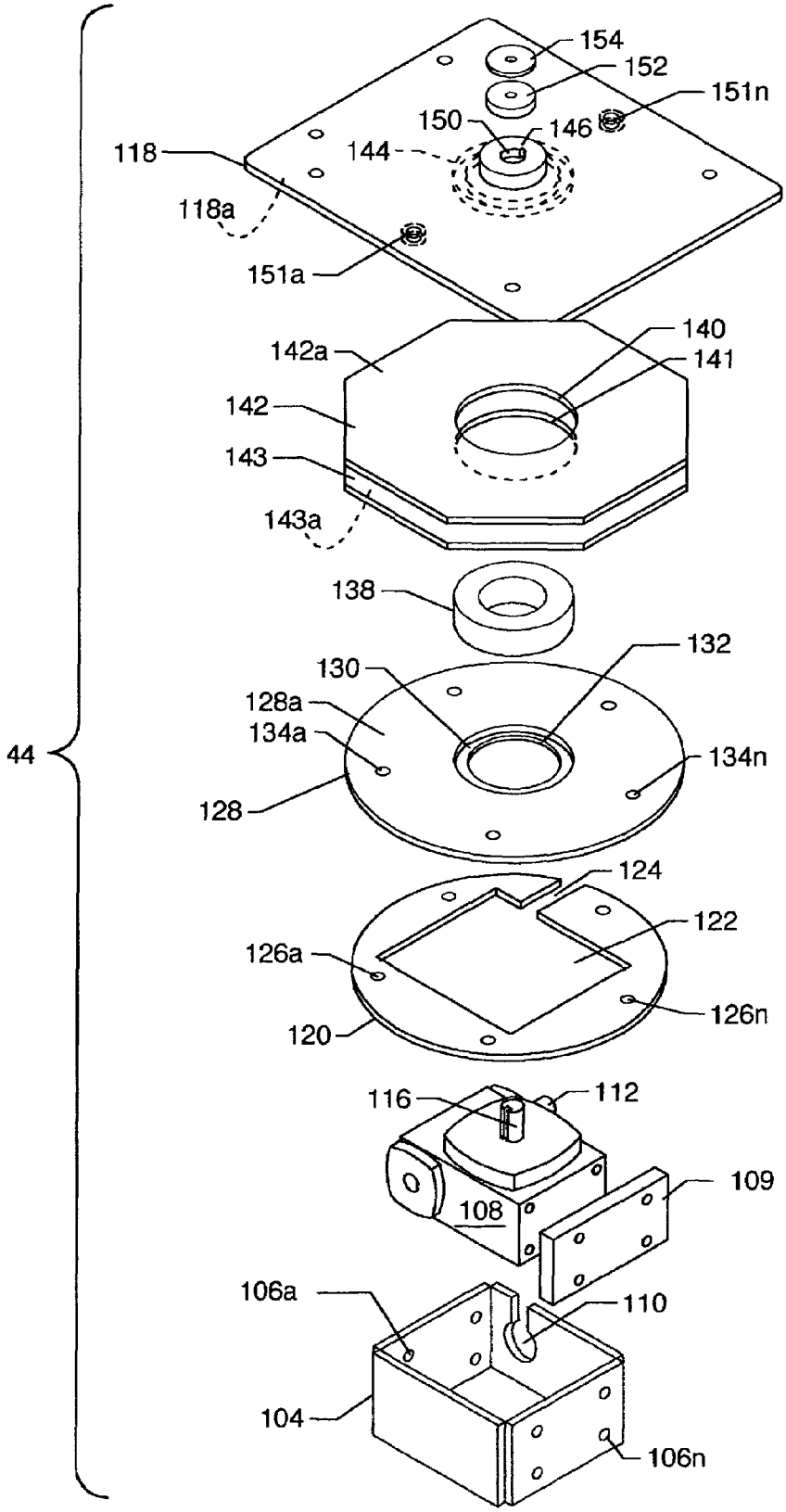
FIG. 7 illustrates an exploded isometric view of the upper assembly.
Figure 8:
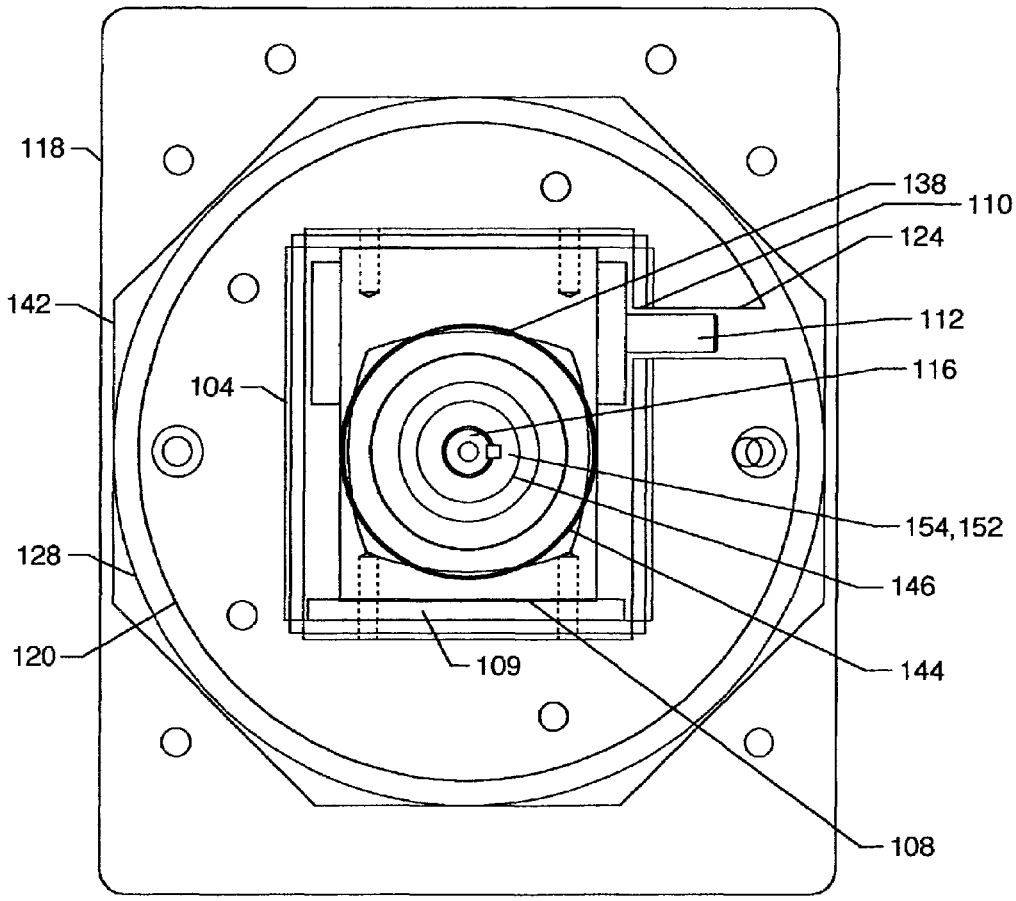
FIG. 8 illustrates a top view of the component alignment of the upper assembly.

FIG. 5 illustrates a side view of the upper assembly 44 in partial cross section mounted to the top of the tubular column 30 and including an angled worm drive 100 and motor 102 shown distanced from the upper assembly 44 for the purpose of brevity and clarity. FIG. 6 illustrates an exploded side view of the upper assembly 44, FIG. 7 illustrates an exploded isometric view of the upper assembly 44, and FIG. 8 illustrates a top view of the component alignment of the upper assembly 44 substantially without the use of hidden lines. The upper assembly 44 is now described with understood reference to one, more than one, or all of the illustrations shown in FIGS. 5–8. A five-sided mounting box 104 is suitably secured such as by welding to the top of the positionable outer tube 38 at the top of the tubular column 30. A plurality of body holes 106*a*–106*n* for accommodation of mounting hardware (not shown) for mounting of a worm gear drive 108 and interceding shim 109 (FIGS. 6 and 7) are located about the mounting box 104. A slotted hole 110 is included in one side of the mounting box 104 to accommodate a horizontally extending worm gear drive input shaft 112 extending from the worm gear drive 108. The worm gear drive input shaft 112 extends into and extends to be exposed and accessible at the outwardly located side of the angled worm drive 100. The motor 102 powers the angled worm drive 100 which in turn powers the worm gear drive input shaft 112 to turn the worm gear drive 108. An encoder 103, which can be optional, and which is located between the motor 102 and the angled worm drive 100, is in communication with the shaft of the motor 102. The encoder 103 senses and relays rotational information of the shaft of the motor 102 to the microprocessor 23 to determine and control the azimuthal position of the digital display panel 18 for automatic or remote control, as described later in detail. In the alternative, a hand crank can be inserted into a configured receptor hole 114 (FIG. 3) in the end of the worm gear drive input shaft 112 to actuate the worm gear drive 108 to power the upper assembly 44. A keyed vertically oriented worm gear drive output shaft 116 extends from the worm gear drive 108 to engage the hub shaft 146 of a rectangularly shaped positionable rotation plate 118. A flange 120, being substantially in the shape of a disk, is suitably secured, such as by welding, to the top of the mounting box 104. A rectangular cutout 122 and a connected slot 124 are located in the flange 120, each being sized larger than the profile of the worm gear drive 108 and worm gear drive input shaft 112, respectively, allowing for placement or replacement of the worm gear drive 108 and worm gear drive input shaft 112, respectively, through the flange 120. A plurality of body holes 126*a*–126*n* are included. A disk-shaped fixed rotation plate 128 including a centrally located and co-centered bearing seat 130 and hole 132 and a plurality of holes 134*a*–134*n* secures to the upper surface of the flange 120 by a plurality of machine screw assemblies 136*a*–136*n* extending through the body holes 126*a*–126*n* of the flange 120 and into engagement with the holes 134*a*–134*n* of the fixed rotation plate 128. A ball bearing assembly 138 aligns in the bearing seat 130 of the fixed rotation plate 128 and extends upwardly beyond the upper planar surface 128*a* of the fixed rotation plate 128 to extend through the centrally located and larger adequately spaced holes 140 and 141 of similarly shaped stacked upper and lower UHMW plastic stabilizing disks 142 and 143 to align to a bearing seat 144 and over a centrally located hub shaft 146 of the rectangularly shaped positionable rotation plate 118 to offer central rotational support for the positionable rotation plate 118. The hub shaft 146 includes a keyed bore 150 which accommodates the keyed worm gear drive output shaft 116 of the worm gear drive 108 to facilitate rotation about a vertical axis of the positionable rotation plate 118. A plurality of body holes 151*a*–151*n* align about the positional rotation plate 118 to accommodate fastening of the positional rotation plate 118 to the horizontal tubes 46 and 48 and components attached thereto, as well as to the solar panel support bar 68 and components attached thereto including but not limited to the digital display panel 18, respectively. The upper and lower UHMW plastic stabilizing disks 142 and 143 are in intimate and mutual planar contact with each other. The upper and lower planar surfaces 142*a* and 143*a*, respectively, of the upper and lower UHMW plastic stabilizing disks 142 and 143 are in close juxtaposition with the lower planar surface 118*a* of the positionable rotation plate 118 and the upper planar surface 128*a* of the fixed rotation plate 128, respectively, to offer lateral wide based rotational support for the positionable rotation plate 118. Such wide based support is especially helpful in compensating for side loads such as produced by winds or by not being level during rotation by offering additional lateral support. A rubber cap 152 and a dust cap 154 are positioned at the top of the hub shaft 146.

FIG. 9 illustrates circuitry for electronic azimuth control of the digital display panel 18, including a microprocessor 23, interface 156, directional control relays 158 and 160, an activation relay 162, manual switch 164, encoder 103, a plurality of diodes 166*a*–166*n*, and a plurality of onboard batteries 168*a*–168*n*, one or more of which can be charged by the solar array 20. Directional control relays 158 and 160 are actuated in various manners one at a time to deliver desired polarity voltage to energize the motor 102 to rotate in the appropriate direction to azimuthally position the digital display panel 18.

The motor 102 can be controlled by the manual switch 164 to provide manual powered operation of the motor 102 by energizing either relay 158 or 160 to connect either battery 168*b* or 168*c* of desired polarity voltage which connects through the activation relay 162 to the motor 102 for azimuth positioning of the digital display panel 18.

The microprocessor 23 can be utilized to provide for automatic azimuthal positioning of the display panel 18, such as at appropriate time intervals where the display panel 18 would be rotated to provide for maximum viewing. For example, such rotation could be provided for the portable sign system 10 for maximum desired exposure, such as either direction at the side of a roadway or freeway where the digital display panel 18 would be rotated at an appropriate time to be viewed by the maximum number of viewers transiting the roadway depending on the direction of travel. The microprocessor 23 can control the rotation of the motor 102, as desired, through the interface 156 and either of the directional relays 158 or 160 and the activation relay 162. During rotation of the motor 102, the encoder 103 references the number of revolutions of the shaft of the motor 102 which is sensed by the microprocessor 23 through the interface 156. When the desired rotation has occurred, as sensed by the encoder 103, the microprocessor 23 de-energizes the engaged directional relay (158 or 160) to remove electrical power from and to interrupt rotation by the motor 102.

The microprocessor 23 can also be controlled remotely to cause similar operation, as just previously described. Such remote operation could be provided by various methods, such as, but not limited to, direct wire control, computer control by modem, over a telephone line or internet line, radio frequency or infrared inputs, satellite inputs, or other such input methods delivered to or sensed by devices to provide a remote input 170 to the microprocessor 23 and associated components.

Mode of Operation

Figure 10:
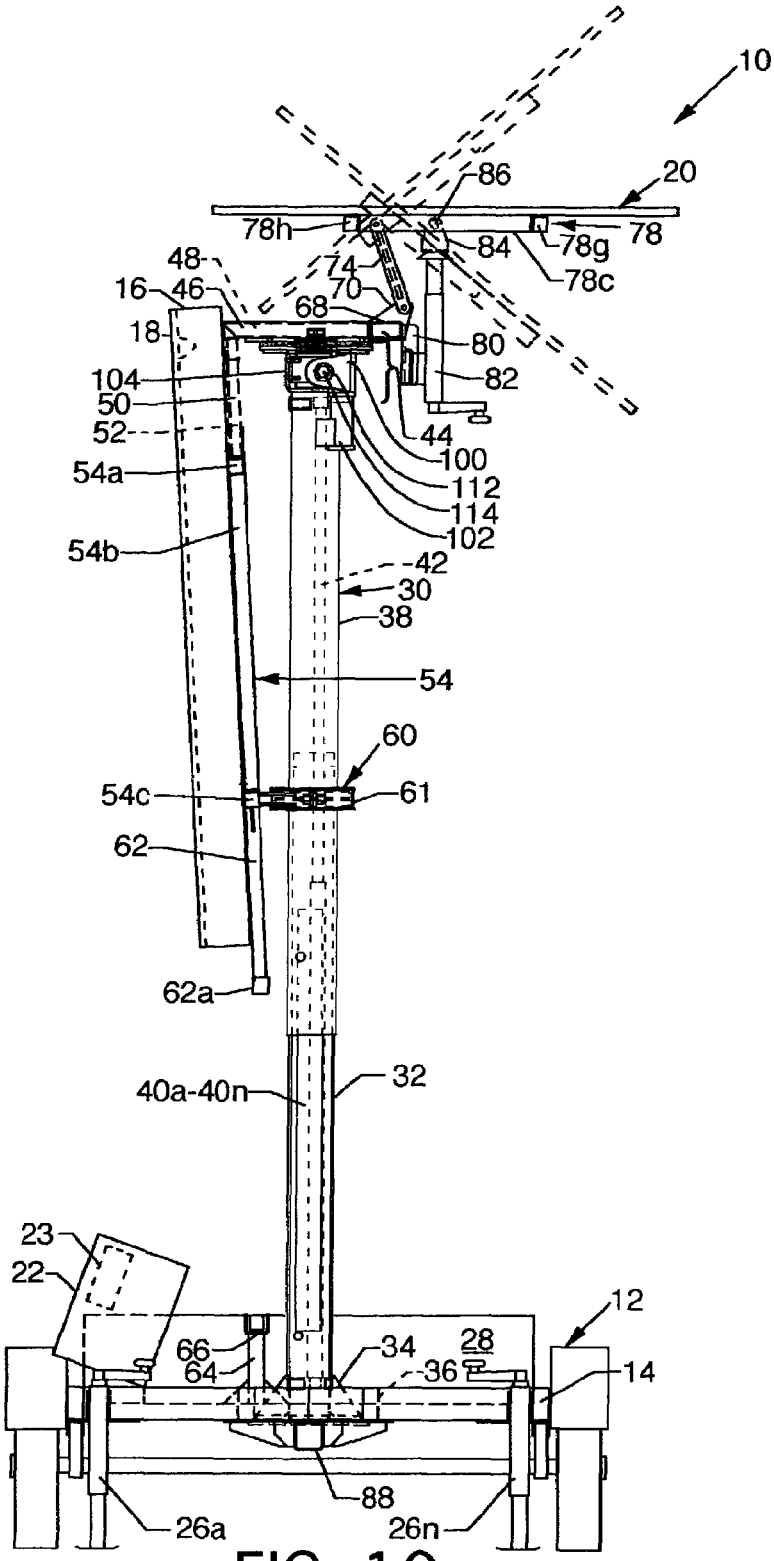

FIG. 10 illustrates the mode of operation of the portable sign system 10. The portable sign system 10 is towed to a suitable site whereupon the jacks 26*a*–26*n* are rotated vertical and then extended to stabilize the trailer frame 14 with the site. Pins 96 and 98 are then removed to allow for removal of the detachable tow bar 24 from tow bar receptors 88 and 92, thereby rendering the invention nontowable by conventional means. Pin 65 is withdrawn from the channel 66 and the horizontal tube 62*a* to unlock the framework 54 and attached digital display panel 18, peripheral digital display panel frame 16 and other attached or related components in preparation for deployment of such components upwardly. The control panel 22 and microprocessor 23 are then utilized to control the functions of the portable sign system 10 to operate the mechanical functions and to program the messages displayed on the digital display panel 18. The hydraulic actuating cylinder 42 is controlled at the control panel 22 to smoothly raise the positionable outer tube 38 vertically along the UHMW plastic panels 40*a*–40*n* and the fixed inner tube 32 to or through a minimum positional height. Such raising positions the digital display panel 18 to or through the minimum positional height where rotational interference by the control panel 22 with the digital display panel 18 is not a factor. When past the minimum positional height, the digital display panel 18 and the solar array 20 can be azimuthally positioned either at the minimum positional height or at a further extended height. Azimuthal positioning of the digital display panel 18 and the solar array 20 can be accomplished manually by a hand crank, if required, or electrically by the motor 102, such as described in reference to FIG. 9, utilizing the components or associated components of the upper assembly 44 located at the top of the tubular column 30. The angled worm drive 100 is actuated by the motor 102 or by the hand crank inserted into the receptor hole 114 of the worm gear drive input shaft 112 to actuate the worm gear drive 108. Actuation of the worm gear drive 108 imparts rotational movement of the worm gear drive output shaft 116 to the positionable rotation plate 118 to position the attached horizontal tubes 46 and 48, tubes 50 and 52, framework 54, the digital display panel 18 and other supporting or related components, as well as the attached solar panel framework 78 and components supporting or affecting the operation of the solar array 20. The positionable rotation plate 118 (FIG. 5) and the structure mounted thereto are supported by various components and geometrical configurations of the upper assembly 44 to provide for load support and for stabilizing support of such structure. The ball bearing assembly 138 provides for a portion of the load support of the overhead structure and components attached to the overhead structure such as that of the digital display panel 18, the solar array 20 and attached support structure in association with flange 120, the fixed rotation plate 128, and the positionable rotation plate 118. Stabilizing support, as well as a portion of load support, is provided across a broad base which spans the breadth of the upper assembly 44 in addition to that support provided by the ball bearing assembly 138. The wide ranging relationship of the upper and lower UHMW plastic stabilizing disks 142 and 143 in close intimate contact between the fixed rotation plate 128 and the positionable rotation plate 118 provides for greater stability of the loads carried by the invention. More specifically, the upper surface 142*a* of the upper UHMW plastic stabilizing disk 142 is in intimate wide base rotational contact with the lower planar surface 118*a* of the positionable rotation plate 118 and the lower planar surface 143*a* of the lower UHMW plastic stabilizing disk 143 is in wide base intimate rotational contact with the upper planar surface 128*a* of the fixed rotation plate 128. Side loads imposed by the digital display panel 18 and the solar array 20, as well as other support structures, are transmitted to and are encountered by and stabilized by the wide ranging broad base relationship of the fixed rotation plate 128, the upper and lower UHMW plastic stabilizing disks 142 and 143 and the positionable rotation plate 118. Rotational stabilizing of the digital display panel 18 is provided for by the support bearing 60 while the digital display panel 18 is rotated. The solar array 20 is positioned by the jack 82 about the dual plate linkage bars 74 and 76 and the angled bracket 84 to various positions, as shown by dashed lines, for the best presentation to the sun.

Various modifications can be made to the present invention without departing from the apparent scope hereof.

PORTABLE SIGN SYSTEM PARTS LIST

| | |
|---|---|
| 10 | portable sign system |
| 12 | trailer |
| 14 | trailer frame |
| 16 | peripheral digital display panel frame |
| 18 | digital display panel |
| 20 | solar array |
| 22 | control panel |
| 23 | microprocessor |
| 24 | detachable tow bar |
| 26a–n | jacks |
| 28 | platform |
| 30 | tubular column |
| 32 | inner tube |
| 34 | base |
| 36 | boxed framework |
| 38 | positionable outer tube |
| 40a–n | UHMW plastic panels |
| 42 | hydraulic actuating cylinder |
| 44 | upper assembly |
| 46 | horizontal tube |
| 48 | horizontal tube |
| 50 | tube |
| 52 | tube |
| 54 | framework |
| 54a–n | tubes |
| 56 | attachment points |
| 58 | tube |
| 60 | support bearing |
| 61 | collar |
| 62 | stabilizer bar |
| 62a | horizontal tube |
| 64 | stabilizer bar receptor |
| 65 | pin |
| 66 | channel |
| 68 | solar panel support bar |
| 70 | pivot plate |
| 72 | pivot plate |
| 74 | dual plate linkage bar |
| 76 | dual plate linkage bar |
| 78 | solar panel framework |
| 78a–b | cross member channels |
| 78c–f | cross member angles |
| 78g–h | cross member tubes |
| 80 | bracket |
| 82 | manually operated jack |

-continued

PORTABLE SIGN SYSTEM PARTS LIST

| | |
|---|---|
| 84 | angled bracket |
| 86 | pin |
| 88 | tow bar receptor (front) |
| 90 | female connector/brake assembly |
| 92 | tow bar receptor (rear) |
| 94 | ball connector |
| 96 | pin |
| 98 | pin |
| 100 | angled worm drive |
| 102 | motor |
| 103 | encoder |
| 104 | mounting box |
| 106a–n | body holes |
| 108 | worm gear drive |
| 109 | shim |
| 110 | slotted hole |
| 112 | worm gear drive input shaft |
| 114 | receptor hole |
| 116 | worm gear drive output shaft |
| 118 | positionable rotation plate |
| 118a | lower planar surface |
| 120 | flange |
| 122 | rectangular cutout |
| 124 | slot |
| 126a–n | body holes |
| 128 | fixed rotation plate |
| 128a | upper planar surface |
| 130 | bearing seat |
| 132 | hole |
| 134a–n | holes |
| 136a–n | machine screw assemblies |
| 138 | ball bearing assembly |
| 140 | hole |
| 141 | hole |
| 142 | upper UHMW plastic stabilizing disk |
| 142a | upper planar surface |
| 143 | lower UHMW plastic stabilizing disk |
| 143a | lower planar surface |
| 144 | bearing seat |
| 146 | hub shaft |
| 150 | keyed bore |
| 151a–n | body holes |
| 152 | rubber cap |
| 154 | dust cap |
| 156 | interface |
| 158 | directional control relay |
| 160 | directional control relay |
| 162 | activation relay |
| 164 | manual switch |
| 166a–n | diodes |
| 168a–n | batteries |
| 170 | remote input |

What is claimed is:

1. A portable sign system comprising:

a. a self-contained digital display panel which can be hydraulically raised to a suitable height and subsequently be rotated by a worm gear which is manually driven or electrically driven by a motor;

b. a broad based upper assembly having an UHMW plastic stabilizing plate and rotation plates and attached worm gear drive which serves as a rotatable and stabile mount for said self-contained digital display panel and an attached solar array;

c. the self-contained digital display panel automatically locking in azimuthal position by the worm gear drive; and, d. an azimuth orientation means for the self-contained digital display panel selected from the group consisting of a hand crank, an electrical manual switch, an onboard computer control, and a remote control.

2. The portable sign system of claim 1, further comprising:

a. at least one battery; and, b. wherein the self-contained digital display panel is powered by the at least one battery.

3. The portable sign system of claim 2, wherein the at least one battery is charged by the solar array.

4. The portable sign system of claim 1, further comprising a wheeled trailer frame carrying the self-contained digital display panel, upper assembly and azimuth orientation means.

5. The portable sign system of claim 4, wherein the wheeled trailer frame includes a tow bar.

6. The portable sign system of claim 5, wherein the tow bar is detachable.

7. The portable sign system of claim 6, wherein the tow bar is detachable from a tow receptor.

8. The portable sign system of claim 7, wherein a detachable tow bar storage receptor is provided, the storage receptor receiving the detachable tow bar in a location rendering the tow bar unavailable for towing purposes.

9. The portable sign system of claim 7, wherein the detachable tow bar may be locked within the tow receptor.

10. The portable sign system of claim 4, wherein the wheeled trailer includes at least one jack for stabilizing the wheeled trailer frame.

11. The portable sign system of claim 10, wherein the at least one jack is one of four jacks, each of the jacks being located adjacent a corner of the wheeled trailer frame.

12. The portable sign system of claim 1, wherein the system is characterized by interconvertability between a travel orientation and a display orientation.

13. The portable sign system of claim 12, wherein the travel orientation is characterized by a hydraulically lowered digital self-contained display panel in azimuth alignment for minimal wind resistance during travel and wherein the display orientation is characterized by a hydraulically raised self-contained digital display panel in azimuth orientation for maximum visibility to convey a displayed message.

14. The portable sign system of claim 13, wherein the travel orientation is further characterized by azimuth alignment of the solar array for minimal wind resistance during travel and wherein the display orientation is further characterized by further inclined angled orientation of the solar array relative to the sun while coupled to the azimuth orientation of the self-contained digital display panel.

15. A portable sign system comprising:

a. a wheeled trailer frame;

b. a central column mounted on the trailer frame;

c. an upper assembly secured to the central column;

d. a suspension support structure supported by the upper assembly and rotatable relative to the central column by the upper assembly;

e. a digital display panel carried by the suspension support structure;

f. rotational control means for azimuth control of the digital display panel relative to the wheeled trailer frame; and, g. a power supply for the digital display panel.

16. The portable sign system of claim 15, further comprising a detachable tow bar for the trailer frame.

17. The portable sign system of claim 15, further comprising at least one trailer frame stabilizing jack mounted adjacent at least one corner of the wheeled trailer frame.

18. The portable sign system of claim 15, wherein the central column is telescopic.

19. The portable sign system of claim 18, wherein the central column includes a hydraulic actuating cylinder to enable telescopic elevation of the digital display panel relative to the wheeled trailer frame.

20. The portable sign system of claim 18, wherein the telescopic central column includes an inner member and an outer member and an UHMW plastic panel interposed between the inner and outer members.

21. The portable sign system of claim 20, wherein the inner member and the outer member are formed from square tubular stock.

22. The portable sign of claim 15, wherein the power supply includes at least one battery.

23. The portable sign system of claim 22, wherein the power supply includes a solar array to charge the at least one battery.

24. The portable sign system of claim 23, wherein the solar array is carried by the suspension support structure.

25. The portable sign system of claim 24, wherein the solar array further includes an incline control means.

26. The portable sign system of claim 25, wherein the incline control means includes a jack and pivot support.

27. The portable sign system of claim 24, wherein the solar array may be pinned in a low profile transport orientation.

28. The portable sign system of claim 15, wherein the rotational control means includes a worm gear drive in the upper assembly.

29. The portable sign system of claim 28, wherein the worm gear drive is manually actuated.

30. The portable sign system of claim 28, wherein the worm gear drive is power actuated.

31. The portable sign system of claim 30, wherein the worm gear drive is hydraulically actuated.

32. The portable sign system of claim 30, and wherein the worm gear drive is electrically actuated.

33. The portable sign system of claim 32 and wherein the electrical actuation of the worm gear drive is manually operated.

34. The portable sign system of claim 33, wherein the electrical actuation of the worm gear drive is under microprocessor control.

35. The portable sign system of claim 34, wherein the microprocessor control is remotely controlled.

36. The portable sign system of claim 35, wherein the remote control of microprocessor control includes a communication selected from the group consisting of direct wire control communication, modem communication, telephone communication, internet communication, radio frequency communication, infrared communication, and satellite communication.

37. The portable sign system of claim 34, wherein the microprocessor control is locally controlled.

38. The portable sign system of claim 37, wherein the locally controlled microprocessor control is directed by a locally stored software program.

39. The portable sign system of claim 28, wherein the azimuth orientation is detected.

40. The portable sign system of claim 39, wherein the detection of azimuth orientation includes referencing worm gear revolutions.

41. The portable sign system of claim 39, wherein azimuth orientation is communicated to a microprocessor.

42. The portable sign system of claim 41, wherein azimuth orientation communications are employed to determine whether to terminate or continue actuation of the worm gear drive.

43. The portable sign system of claim 42, wherein azimuth orientation communications are transmitted to a remote location.

44. The portable sign system of claim 28, wherein the worm gear drive serves as a brake to prevent rotation when not actuated.

45. The portable sign system of claim 15, wherein the upper assembly includes a first UHMW plastic stabilizing disk.

46. The portable sign system of claim 45, wherein the upper assembly includes a second UHMW plastic stabilizing disk, the second UHMW plastic stabilizing disk bearing against the first UHMW plastic stabilizing disk, the first and second UHMW plastic stabilizing disks together providing a friction control system to the upper assembly.

47. The portable sign system of claim 15, further comprising support bearing rotatably securing the suspension support structure to the central column.

48. The portable sign of claim 15, further comprising a travel lock means for restricting azimuth rotation of the suspension support structure relative to the wheeled trailer frame.

49. The portable sign system of claim 48, wherein the travel lock means includes a stabilizer bar downwardly directed from the suspension support structure, spaced apart from the central column, and a receptor for the stabilizer bar on the wheeled trailer frame.

50. The portable sign system of claim 15, wherein the suspension support structure carries the digital display panel at an angle of less than 90 degrees to horizontal.

51. A method of communicating a digital message to a viewer, the method comprising the steps of:

a. providing a digital message;

b. providing a portable sign system, the portable sign system including:

(1) a wheeled trailer frame;

(2) a central column mounted on the trailer frame;

(3) an upper assembly secured to the central column;

(4) a suspension support structure supported by the upper assembly and rotatable relative to the central column by the upper assembly;

(5) a digital display panel carried by the suspension support structure;

(6) rotational control means for azimuth control of the digital display panel relative to the wheeled trailer frame; and, (7) a power supply for the digital display panel;

c. rotating the digital display panel about the central column to a desired azimuth orientation relative to the wheeled trailer frame, the desired azimuth orientation being viewable by the viewer; and, d. causing the digital display panel to display the digital message, thereby communicating the message to the viewer.

52. The method of claim 51, wherein the viewer is in a vehicle moving along a roadway, the portable sign system is situated adjacent the roadway, and the desired azimuth orientation is viewable by the viewer in the moving vehicle.

53. A method of communicating a digital message, the method comprising the steps of:

a. providing a digital message;

b. providing a portable sign system, the portable sign system including:

(1) a wheeled trailer frame;

(2) a central column mounted on the trailer frame;

(3) an upper assembly secured to the central column;

(4) a suspension support structure supported by the upper assembly and rotatable relative to the central column by the upper assembly;

(5) a digital display panel carried by the suspension support structure;

(6) rotational control means for azimuth control of the digital display panel relative to the wheeled trailer frame; and, (7) a power supply for the digital display panel;

c. rotating the digital display panel about the central column to a desired azimuth orientation relative to the wheeled trailer frame, the desired azimuth orientation being viewable by a viewer in a vehicle moving along a roadway adjacent the portable sign;

d. causing the digital display panel to display the digital message, thereby communicating the message to the viewer;

e. wherein a second vehicle travels the roadway at a different time and direction than the viewer in the vehicle, the second vehicle having a second viewer, and subsequent to viewing by the viewer, rotating the digital display panel about the central column to a second desired azimuth orientation relative to the wheeled trailer frame, the second desired azimuth orientation being viewable to the second viewer; and, f. causing the digital display panel to display the digital message, thereby communicating the message to the second viewer.

54. The method of claim 53, wherein the rotation steps are controlled by a microprocessor.

55. The method of claim 54, wherein the azimuth orientation is detected and communicated to a microprocessor.

56. The method of claim 54, wherein the microprocessor is remotely controlled.

* * * * *